United States Patent [19]

Long et al.

[11] 4,309,595

[45] Jan. 5, 1982

[54] HAIR DRYER

[75] Inventors: Douglas G. Long, Lombard; William R. Hemrich, Glen Ellyn; Nicholas A. Shaw, Glendale Heights, all of Ill.

[73] Assignee: Sunbeam Corporation, Chicago, Ill.

[21] Appl. No.: 167,868

[22] Filed: Jul. 14, 1980

[51] Int. Cl.[3] ..... A45D 20/12

[52] U.S. Cl. ..... 219/370; 219/373; 219/375; 34/96; 34/97

[58] Field of Search ..... 219/367-371, 219/373-376; 475/500; 417/326; 34/96-98, 243 R

[56] References Cited

U.S. PATENT DOCUMENTS

| | | | |
|---|---|---|---|
| 994,259 | 6/1911 | Kazanjian | 219/369 |
| 1,339,510 | 5/1920 | Hoffman . | |
| 2,221,703 | 11/1940 | Falco | 219/375 |
| 2,673,029 | 3/1954 | Lautner | 419/326 |
| 2,705,911 | 4/1955 | Heiman | 417/326 |
| 4,198,557 | 4/1980 | Crowley | 219/370 |

*Primary Examiner*—Gene Z. Rubinson
*Assistant Examiner*—Bernard Roskoski
*Attorney, Agent, or Firm*—George R. Clark; Neil M. Rose; Clifford A. Dean

[57] ABSTRACT

A hand held hair dryer housing with a relatively small open end and a relatively large opposite open end, heater means, and a reversible motor-driven fan for selectively providing either a concentrated or a diffused flow of heated air through said small or large open ends of said housing, respectively.

13 Claims, 2 Drawing Figures

10
12
14
16
18
20
26
28
30
32
33
38
38a
40
42
44
46
48
50
51
52
54
55
56
58
60
62
66
68
70
72
74
76
78
80
82
86
88
90
92
94
96
98
104
106
108
110
112
116
118
120
122
124
126
128
130
4.

HAIR DRYER

BACKGROUND OF THE INVENTION

The present invention relates to hand held hair dryers. With the many different type hair styles currently in fashion, it is often necessary to use either or both concentrator or diffuser attachments on standard hand held hair dryers in order to provide the desired styling effects. As attachments in general are easily mislaid or lost, the necessity of relying on same can become more than a mere nuisance. Prior art examples of concentrator and/or diffuser attachments for hair dryers include U.S. Design Pat. Nos. 237,117, 239,885, 247,630 and 247,980, copies of which are attached, and applicants' assignee's pending design application Ser. No. 111,413, filed Jan. 11, 1980, a copy of the drawing thereof also being attached.

BRIEF DESCRIPTION OF THE INVENTION

The hair dryer embodying our invention overcomes the problem resulting from the previously-discussed need for the use of attachments by simply eliminating the necessity for their use. By providing a hair dryer housing having one end provided with a small opening adapted to provide a concentrated flow of heated air therefrom and the other end provided with a large opening adapted to provide a diffused flow of air therefrom and a reversible motor-driven fan to selectively provide a heated air flow through either end, the need for separate concentrator and/or diffuser attachments is eliminated. Mechanical means are provided which permit actuation of the motor-reversing switch only when a "heat/speed" switch is in an "off" position.

DESCRIPTION OF THE PREFERRED EMBODIMENT

Figure 1:
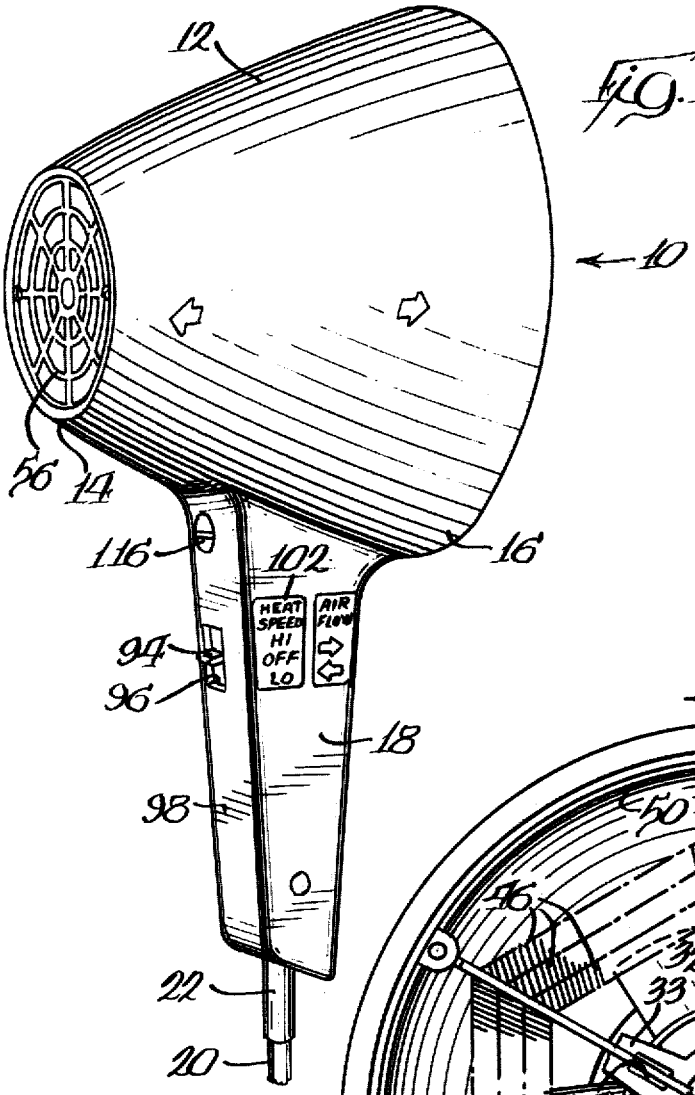
FIG. 1 is a side perspective view of a hair dryer embodying our invention.

Referring now to the drawings, there is shown in FIG. 1 a hair dryer which is designated generally by the reference numeral 10. The hair dryer 10 is characterized by a housing 12 having a configuration such that a small opening 14 is provided at one end thereof and a large opening 16 is provided at the opposite end thereof. Depending upon the direction of air flow through the housing 12, the flow of heated air may be either a concentrated flow through the smaller open end 14 or a more gentle diffused flow through the larger end 16. Although the preferred configuration is that of a generally truncated, cone-shaped housing 12 as shown in the drawings, it is to be understood that the housing could be angular or have an elliptical or other cross-sectional configuration as long as there is provided a small opening at one end and a substantially larger opening at the opposite end. The housing 12 is provided with a handle 18 which extends radially therefrom and generally normal to the longitudinal axis of the housing 12. A power cord 20 extends into the end of the handle 18 and may be provided with a conventional strain relief 22.

Figure 2:
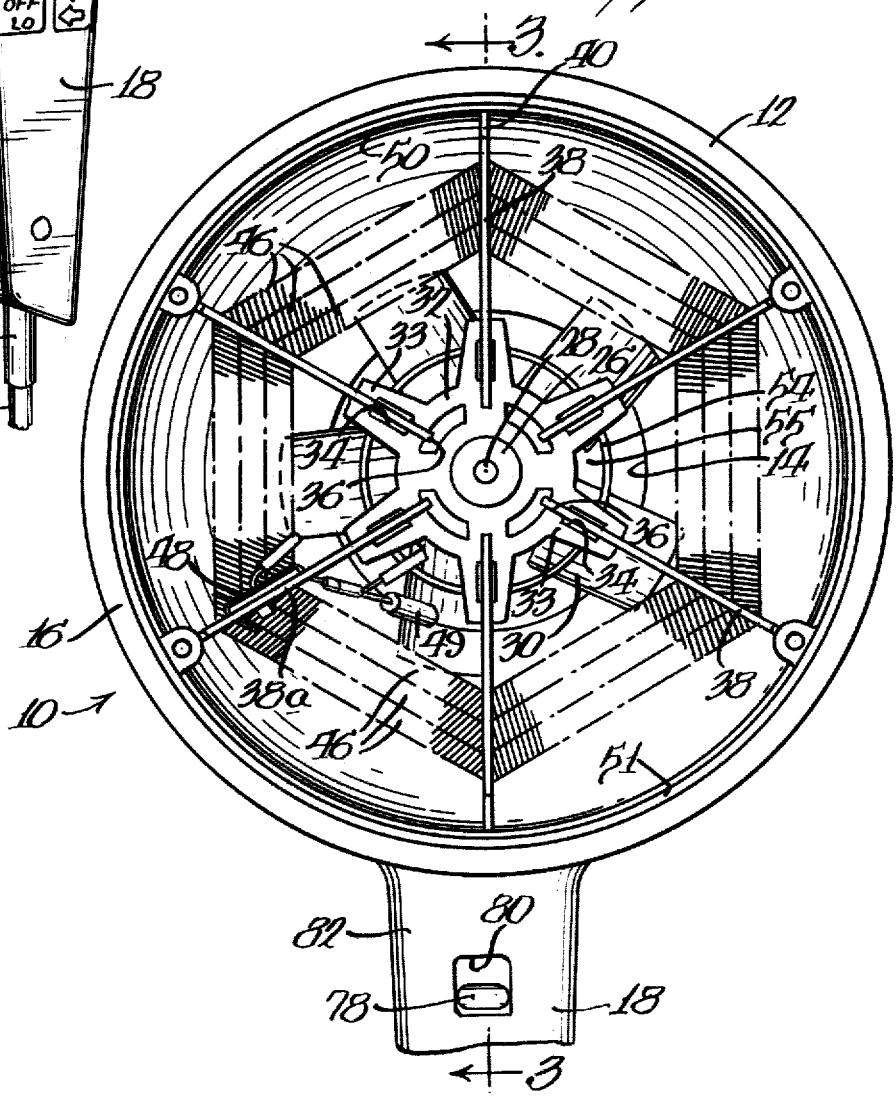
FIG. 2 is an end elevational view on an enlarged scale looking toward the larger end of the hair dryer, part of the handle being broken away, and the grid and safety screen being removed.

A reversible D.C. motor 26 is supported within the housing 12 with its axis disposed along the longitudinal axis of the housing 12. A drive shaft 28 extending toward the smaller end 14 of the housing 12 has a known type fan 30 mounted thereon. A pair of identical spider members 32 are secured to each end of the motor 26 with each spider member 32 being provided with six equidistantly spaced, radially extending arms 33, the arms of the two spider members 32 being longitudinally aligned. As best illustrated in FIG. 2, each arm 33 is slotted, as at 34, to receive the inner edge 36 of a radially disposed heater card 38. The outer edge of each heater card 38 is provided with a pair of end tabs 40 which are received in notches or slots 42 formed on the inner surface of the housing 12. Therefore, as is best illustrated in FIG. 2, the motor 26 and the fan 30 are supported within the housing by the two spider members 32 and the six radially disposed heater cards 38.

The outer edges of the heater cards 38 are provided with a series of small notches 44 which facilitate mounting a series of heater coils 46 therebetween, in a manner best shown in FIG. 2, whereby the heater coils 46 may be described as being wound annularly about the motor 26. Included in the heater coil circuitry is a thermostat 48 which is mounted on the heater card **38*a*. A fuse 49 is also incorporated in the heater coil circuitry as an additional safety measure. A generally truncated, cone-shaped heat shield 50 is provided between the heater coils 46 and the inner surface of the housing 12 with the heater card tabs 40 extending through suitable slots in the heat shield 50 whereby the shield 50 is spaced slightly inwardly of the inner surface of the housing 12 to provide an insulating air gap 51 therebetween. The inner edges of the heater cards 38 are provided with notches 52 which extend generally the length of the motor 26 whereby to accommodate a cylindrical heat shield 54 between the heater coils 46 and the motor 26. This arrangement also defines longitudinally extending passageways 55 inwardly of the heat shield 54 for cooling air adjacent the motor 26**.

The small concentrator end 14 of the housing 12 is provided with a screen/grid structure 56 which is mounted in an annular slot 58 formed on the inner surface of the small end 14 of the housing 12. The large diffuser end 16 of the housing 12 is likewise provided with a screen/grid structure 60 which is mounted in an annular slot 62 formed on the inner surface of the large end 16 of the housing 12. The two screen/grid structures 56 and 60 provided at the two open ends of the housing 12 serve to prevent fingers or elongated objects from coming into contact with the heater coils 46 or the rotating fan 30.

Figures 3, 4:
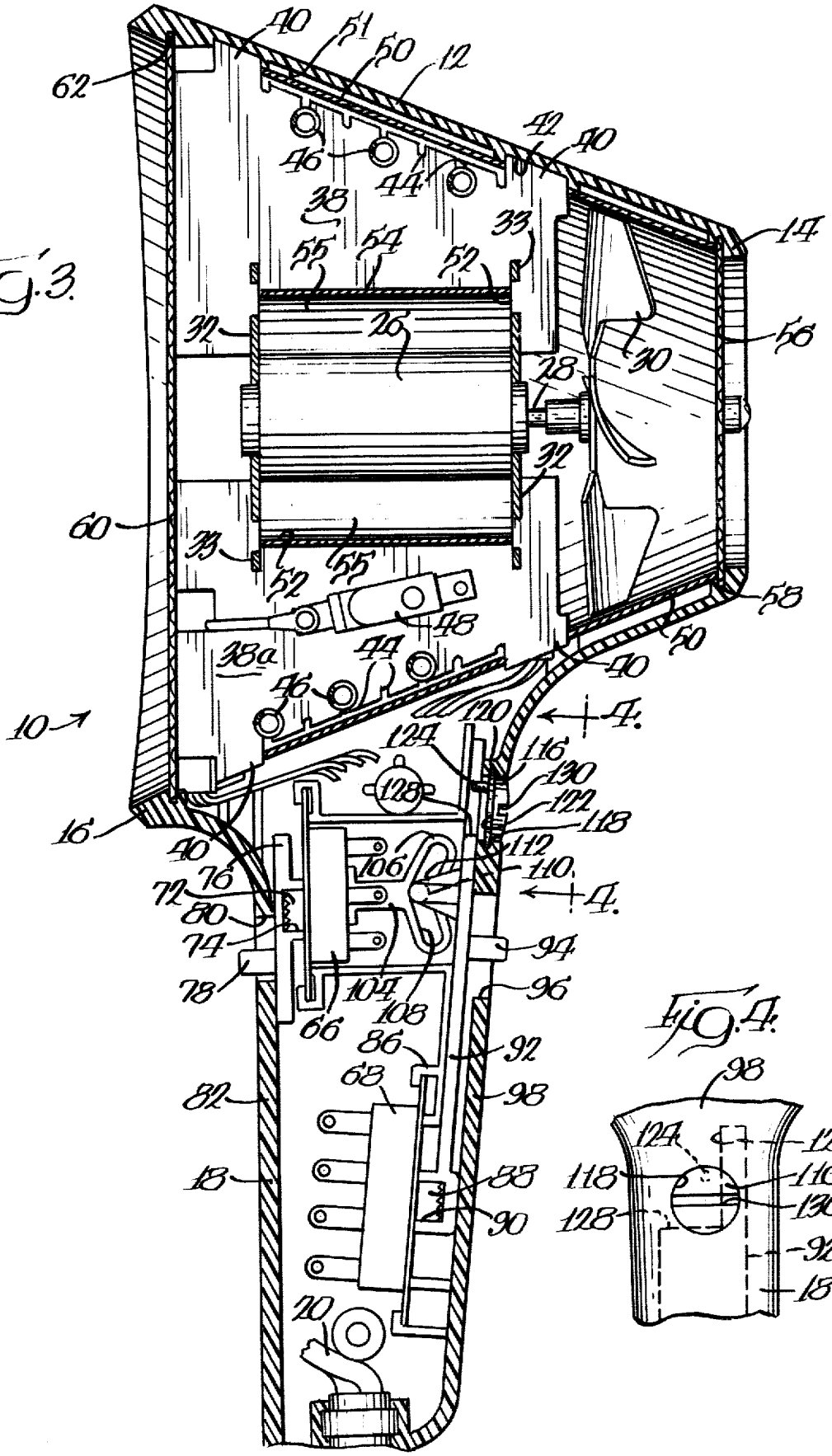
FIG. 3 is a vertical sectional view on a further enlarged scale taken generally along line 3—3 of FIG. 2.
FIG. 4 is a fragmentary end elevational view taken generally in accordance with line 4—4 of FIG. 3.

As is best shown in FIG. 3, a two-position switch 66 is provided for reversing the direction of rotation of the motor 26 and a three-position switch 68 is provided for controlling the heat level and motor speed. Both switches 66 and 68 are provided in the handle structure 18 with the two-position switch 66 being supported therein by a suitable wall structure 70 formed on the inner surface of the handle. An actuator button 72 of the switch 66 is received in a recess 74 formed in a slide member 76 having a finger-engageable portion which extends outwardly through a vertical slot 80 formed in a wall 82 of the handle 18 adjacent the large diffuser end 16 of the housing 12. As shown by handle indicia 84 in FIG. 1, the upper position of switch 66 provides a diffused flow of heated air through the large end 16 of the housing 12 and the lower position of the switch 66 provides a concentrated flow of heated air through the small end 14 of the housing 12. The three-position switch 68 is supported in the handle 18 by a suitable wall structure 86 formed on the inner surface of the handle 18 and has its actuator button 88 received in a recess 90 formed in a slide member 92 having a finger-engageable portion 94 projecting through a vertically extending slot 96 formed in a wall 98 of the handle 18 adjacent the small concentrator end of the hair dryer 10. As shown by handle indicia 102 in FIG. 1, the upper position of switch 68 provides a "high-heat/speed" condition of the hair dryer 10 and the lower position provides a "low-heat/speed" condition of the hair dryer 10. The center position of the switch 68 is an "off" position.

It is important that the motor-reversing switch 66 not be actuated while the motor 26 is operating. Therefore, mechanical means are provided to permit actuation of the motor-reversing switch 66 only when the heat/-speed switch 68 is in its "off" position. It is noted that the slide members 76 and 92 are disposed generally in parallel relationship in the handle 18. Further, a blocking member 104 is provided between the two slide members 76 and 92 and is slidably movable in response to movement of the heat/speed slide member 92 in a direction generally normal to the direction of sliding movement of the two slide members 76 and 92. Guide walls (not shown) are provided for the blocking member 104. The right-hand end of the blocking member 104, as viewed in FIG. 3, is provided with a V-shaped yoke configuration 106 with a V-shaped slot 108 formed therein. A drive pin 110, which depends from a projection 112 formed on the heat/speed slide member 92, is received in the V-shaped slot 108 whereby movement of the heat/speed slide member 92 into either its "high-heat/speed" or "low-heat/speed" positions slidably moves the opposite end of the blocking member 104 to the left, as viewed in FIG. 3, into a suitable position blocking sliding movement of the motor-reversing slide member 76 in either direction and whereby movement of the heat/speed slide member 92 into its central "off" position from either of its heat/speed positions moves the blocking member 104 to the right, as viewed in FIG. 3, into a position permitting actuation of the motor-reversing switch 66.

Mechanical means are also provided to permit use of the hair dryer 10 with either a 120-volt or a 240-volt power supply. A two-position voltage selection control 116 in the form of a circular button is rotatably mounted in an opening 118 provided in the wall 98 of the handle 18 above the finger-engageable portion 94 of the heat/-speed switch 68. As shown in FIGS. 3 and 4, the button 116 has an inner annular flange 120 which is frictionally rotatable in an annular groove 122 formed in the opening 118. A blocking pin 124 extends inwardly of the handle 18 from the inner or rear surface of the button 116 and into a corner notch 126 (best shown in FIG. 4) formed on the upper end of the heat/speed switch slide member 92. With the voltage selection control 116 in its 120-volt position, as shown in FIGS. 3 and 4, the heat/-speed slide member 92 is movable into its upper "high-heat/speed" position. However, upon 180° rotation of the button 116 counterclockwise, as viewed in FIG. 4, into its 240-volt position, a shoulder 128 defined on the slide member 92 by the notch 126 engages the blocking pin 124 whereby to prevent movement of the slide member 92 into its upper "high-heat/speed" position. It is noted that the effective heat and motor speed with the switch 68 in its "low-heat/speed" position, when the hair dryer 10 is plugged into a 240-volt power supply, are comparable to the effective heat and motor speed in the "high-heat/speed" position when the hair dryer 10 is plugged into a 120-volt power supply. The voltage selection control 116 is provided with a screwdriver or coin slot 130 to facilitate rotation of same between its dual voltage positions, which may be indicated by suitable indicia.

While only a single embodiment of the present invention has been shown, it will be understood that various changes and modifications will occur to those skilled in the art, and it is contemplated in the appended claims to cover all such changes and modifications as fall within the true spirit and scope of the present invention.

What is claimed as new and desired to be secured by Letters Patent of the United States is:

1. A hand held hair dryer comprising a generally tubular-shaped housing having a small open end for concentrated air flow therefrom and a substantially larger opposite open end for diffused air flow therefrom, a handle projecting from said housing, heater means disposed in said housing, and a reversible motor mounted in said housing and having a fan driven thereby and means selectively providing either a concentrated or a diffused flow of heated air through said small or large open ends of said housing, respectively, such that air emanating from either of said openings flows in substantially parallel directions.

2. A hand held hair dryer comprising a generally tubular-shaped housing having a small open end for concentrated air flow therefrom and a substantially larger opposite open end for diffused air flow therefrom, a handle associated with said housing, a reversible motor mounted in said housing and having a fan driven thereby, heater means in said housing disposed annularly around said motor, switch means on said handle for reversing the direction of operation of said motor to selectively provide either a concentrated or a diffused flow of heated air through said small or large open ends of said housing, respectively, a first heat shield disposed about said heater means and spaced from the inner surface of said housing, and a second cylindrical heat shield disposed between said motor and said heater means.

3. A hand held hair dryer comprising a generally tubular-shaped housing having a small open end for concentrated air flow therefrom and a substantially larger opposite open end for diffused air flow therefrom, a handle on said housing, a reversible motor mounted in said housing and having a fan driven thereby, heater means disposed in said housing, first switch means movable between two positions for reversing the direction of operation of said motor to selectively provide either a concentrated or a diffused flow of heated air through said small or large open ends of said housing, respectively, second switch means connected to said motor and said heater means and having "high-heat/speed" and "low-heat/speed" end positions and an "off" position disposed therebetween, and mechanical means disposed between said first and second switch means whereby said first switch means is movable between its two positions only when said second switch means is in its "off" position.

4. A hand held hair dryer comprising a housing having a small open end for concentrated air flow therefrom and a substantially larger opposite open end for diffused air flow therefrom, a handle on said housing, a reversible motor mounted in said housing and having a fan driven thereby, heater means disposed in said housing around said motor, first cylindrical heat shield means disposed between said motor and said heater means, second generally conical heat shield means disposed between said heater means and the inner surface of said housing, means spacing said second heat shield means substantially equidistantly from said inner surface of said housing, a first two-position switch for reversing the direction of operation of said motor to selectively provide either a concentrated or a diffused flow of heated air through said small or large open ends of said housing, respectively, a second three-position switch for said motor and heater means having "high-heat/speed", "low-heat/speed" and "off" positions, and a mechanical connection between said first and second switches whereby said first switch is movable between its said two positions only when said second switch is in its said "off" position.

5. A hand held hair dryer comprising a generally truncated cone-shaped housing having a small open end for concentrated air flow therefrom and a substantially larger opposite open end for diffused air flow therefrom, a handle on said housing, heater means disposed in said housing, and a reversible motor mounted in said housing and having a fan driven thereby, and means for selectively providing either a concentrated or a diffused flow of heated air through said small or large open ends of said housing, respectively, such that air emanating from either of said openings flows in substantially parallel directions.

6. A hand held hair dryer comprising a generally truncated cone-shaped housing having a small open end for concentrated air flow therefrom and a substantially larger opposite open end for diffused air flow therefrom, a handle projecting radially from said housing, a motor mounted in said housing and having a fan driven thereby, heater means disposed in said housing, and manually-controlled means switch for reversing the direction of operation of said motor to selectively provide either a concentrated or a diffused flow of heated air through said small or large open ends of said housing, respectively, such that air emanating from either of said openings flows in substantially parallel directions.

7. A hand held hair dryer comprising a generally truncated cone-shaped housing having a small open end for concentrated air flow therefrom and a substantially larger opposite open end for diffused air flow therefrom, a handle projecting radially from said housing at an angle substantially normal to the axis of said housing, a reversible motor mounted in said housing and having a fan driven thereby, heater means disposed in said housing around said motor, and switch means for reversing the direction of operation of said motor to selectively provide either a concentrated or a diffused flow of heated air through said small or large open ends of said housing, respectively, such that air emanating from either of said openings flows in substantially parallel directions.

8. A hand held hair dryer comprising a generally truncated cone-shaped housing having a small open end for concentrated air flow therefrom and a substantially larger opposite open end for diffused air flow therefrom, a handle projecting radially from said housing, a reversible motor mounted in said housing and having a fan driven thereby, heater means in said housing disposed annularly around said motor, means on said handle for reversing the direction of operation of said motor to selectively provide either a concentrated or a diffused flow of heated air through said small or large open ends of said housing, respectively, a generally truncated conical heat shield disposed about said heater means and spaced from the inner surface of said housing, and a cylindrical heat shield disposed between said motor and said heater means.

9. A hand held hair dryer as defined in claim 8 wherein multi-radial-arm spider formations are provided at each end of said motor, wherein the ends of said spider arms are slotted to receive the inner edges of radially disposed heater cards with the outer edges thereof being received in slot means provided on the inner surface of said housing whereby to provide support means for said motor in said housing, said heater means, said housing shield and said motor shield all being supported on or by said heater cards.

10. A hand held hair dryer comprising a generally truncated cone-shaped housing having a small open end for concentrated air flow therefrom and a substantially larger opposite open end for diffused air flow therefrom, a handle projecting radially from said housing, a reversible motor mounted in said housing and having a fan driven thereby, heater means disposed in said housing, first switch means movable between two positions for reversing the direction of operation of said motor to selectively provide either a concentrated or a diffused flow of heated air through said small or large open ends of said housing, respectively, second switch means connected to said motor and said heater means and having "high-heat/speed" and "low-heat/speed" end positions and an "off" position disposed therebetween, and mechanical means disposed between said first and second switch means whereby said first switch means is movable between its two positions only when said second switch means is in its "off" position.

11. The hand held hair dryer of claim 10 wherein both said first and second switch means are characterized by slide members, said slide members being disposed in parallel relationship to one another, a blocking member slidably movable between said slide members in a direction normal to the sliding movements thereof, a V-shaped yoke formed on one end of said blocking member and having a V-shaped slot formed therein, and a pin formed on said slide member of said second "heat/speed control" switch means and received in said V-shaped slot whereby movement of said pin-carrying slide member of said second switch means into either of its end "heat/speed" positions moves said blocking member into a position blocking sliding movement of said slide member of said first "air-flow-direction" switch means and whereby movement of said pin-carrying slide member of said second switch means into said "off" position from either of its end "heat/speed" positions moves said blocking member into a position permitting movement of said first switch means slide member and actuation of said first "air-flow-direction" switch means.

12. A hand held hair dryer comprising a generally truncated cone-shaped housing having a small open end for concentrated air flow therefrom and a substantially larger opposite open end for diffused air flow therefrom, a handle projecting radially from said housing, a reversible motor mounted in said housing and having a fan driven thereby, heater means disposed in said housing around said motor, first cylindrical heat shield means disposed between said motor and said heater means, second heat generally truncated cone-shaped shield means disposed between said heater means and the inner surface of said housing, means spacing said second heat shield means from said inner surface of said housing, a first two-position switch for reversing the direction of operation of said motor to selectively provide either a concentrated or a diffused flow of heated air through said small or large open ends of said housing, respectively, a second three-position switch for said motor and heater means having "high-heat/speed", "low-heat/speed" and "off" positions, and a mechanical connection between said first and second switches whereby said first switch is movable between its said two positions only when said second switch is in its said "off" position.

13. The hand held hair dryer of claim 12 wherein a two-position voltage selection control is provided which has a blocking pin associated therewith which, in the higher voltage position of said control, serves to prevent movement of said second switch into said "high-heat/speed" position.

* * * * *